US007481264B2

(12) United States Patent
Yoshii et al.

(10) Patent No.: US 7,481,264 B2
(45) Date of Patent: Jan. 27, 2009

(54) STEAM CONDENSER

(75) Inventors: Toshihiro Yoshii, Sagamihara (JP); Shunichi Goshima, Tokyo (JP); Yukio Takigawa, Kawasaki (JP); Shoji Nakajima, Yokohama (JP); Tomoko Nakajima, legal representative, Yokohama (JP); Yuuichi Nakajima, legal representative, Yokohama (JP); Miyuki Nakajima, legal representative, Yokohama (JP); Fumio Obara, Tokyo (JP); Akira Nemoto, Tokyo (JP); Shunji Kawano, Yokohama (JP); Yuji Inoue, Kawasaki (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 787 days.

(21) Appl. No.: 11/138,664

(22) Filed: May 27, 2005

(65) Prior Publication Data

US 2006/0032618 A1 Feb. 16, 2006

(30) Foreign Application Priority Data

May 28, 2004 (JP) ..... 2004-159565
Oct. 28, 2004 (JP) ..... 2004-313644

(51) Int. Cl.
*F28B 9/10* (2006.01)

(52) U.S. Cl. ..... 165/114; 165/111; 165/113; 165/DIG. 203

(58) Field of Classification Search ..... 165/111, 165/114, 113, DIG. 184–DIG. 221
See application file for complete search history.

(56) References Cited

U.S. PATENT DOCUMENTS

| | | | | | |
|---|---|---|---|---|---|
| 4,134,450 | A * | 1/1979 | Boyer et al. | ..... | 165/111 |
| 4,367,792 | A * | 1/1983 | Forster et al. | ..... | 165/113 |
| 4,974,669 | A * | 12/1990 | Nagel | ..... | 165/111 |
| 5,960,867 | A * | 10/1999 | Takahashi et al. | ..... | 165/114 |
| 6,041,852 | A * | 3/2000 | Sato et al. | ..... | 165/114 |
| 6,269,867 | B1 * | 8/2001 | Takahashi et al. | ..... | 165/114 |
| 7,370,694 | B2 * | 5/2008 | Shimizu et al. | ..... | 165/111 |
| 2001/0025703 | A1 * | 10/2001 | Blangetti et al. | ..... | 165/111 |

FOREIGN PATENT DOCUMENTS

| | | | |
|---|---|---|---|
| JP | 55-036915 | B2 | 9/1980 |
| JP | 04-324091 | A | 11/1992 |
| JP | 08-226776 | A | 9/1996 |
| JP | 2001-153569 | A | 6/2001 |

* cited by examiner

*Primary Examiner*—Fenn C. Mathew
*Assistant Examiner*—Filip Zec
(74) *Attorney, Agent, or Firm*—Foley & Lardner LLP

(57) ABSTRACT

A steam condenser which condenses steam exhausted from a steam turbine. Heat transfer tubes are arrayed below the steam turbine inside the container. Cooling medium flows inside the heat transfer tubes. The heat transfer tubes extend horizontally, and include at least two upper heat transfer tube groups and at least two lower heat transfer tube groups arranged with a gap between each other. Each heat transfer tube group is constituted by arraying heat transfer tubes like a grid. At a lower part between the lower heat transfer tube groups, a baffle plate which obstructs flow of steam extends horizontally. Between the upper and lower heat transfer tube groups, inter-tube-group inundation prevention plates extend horizontally. In each heat transfer tube group, an enclosure part extends to guide gas from the enclosure part to outside of the container through a gas extraction duct.

19 Claims, 11 Drawing Sheets

STEAM CONDENSER

CROSS-REFERENCE TO RELATED APPLICATIONS

This application is based upon and claims the benefit of priority from the prior Japanese Patent Applications No. 2004-159565 filed on May 28, 2004 and No. 2004-313644 filed on Oct. 28, 2004; the entire contents of which are incorporated herein by reference.

BACKGROUND OF THE INVENTION

1. Field of the Invention

The present invention relates to a steam condenser, and particularly, to a steam condenser having an improved layout of heat-transfer tubes constituting a group of tubes.

2. Description of Related Art

A steam condenser has a function to condense exhausted steam from a steam turbine and collect condensed water thereof. Steam condensers are widely used in steam turbine power plants. In general, a steam condenser has a container communicating with a steam exhaust port of the steam turbine, and the container includes a heat transfer tube group (hereinafter abbreviated as a tube group) consisting of a large number of arrayed heat transfer tubes through which a cooling medium flows.

Steam exhausted from the steam turbine flows down in the container of the steam condenser and contacts the tube group. Then, the steam is deprived of the latent heat by the cooling medium flowing through the heat transfer tubes. The steam is thereby condensed and collected as condensed water. In a conventional steam condenser, condensation of steam progresses due to the temperature difference between steam and the cooling medium. When being condensed, the temperature of steam is a saturation temperature corresponding to partial pressure of steam at the condensation surface.

However, the partial pressure of steam lowers roughly because of two factors. Accordingly, a reduction in temperature difference is thereby caused, so that the condensation performance (or heat exchange efficiency) deteriorates. One of the two factors is a pressure loss caused by flowage of steam. The other factor is increase in partial pressure of noncondensable gas due to concentration of noncondensable gas mixed in the steam. Therefore, it is important for a steam condenser to reduce loss of partial pressure of steam and to suppress concentration of noncondensable gas, in order to improve performance.

In general, the exhaust pressure of a steam turbine is related with the pressure loss of the steam condenser and the noncondensable gas density in the steam condenser. The exhaust pressure of the steam turbine is determined by adding the pressure loss of steam in the steam condenser to the pressure in the tube group where steam is condensed. Therefore, if the pressure loss of steam in the steam condenser is large, the exhaust pressure of the steam turbine is so high that the turbine output is lowered, deteriorating the power generation efficiency.

If there is a place where steam is stagnant, the concentration and the partial pressure of noncondensable gas increase. Then, the partial pressure of steam decreases. In such a case, total condensation rate is secured, so that back pressure of the turbine becomes higher.

Thus, reduction of the pressure loss of steam in the steam condenser and a smooth lead of steam to a gas cooling section without stagnation of steam in the tube group are significant technical subjects as indices of the performance of a steam condenser.

For these subjects, conventional steam condensers have been taking two major different measures. One of the measures is to provide a sufficiently large steam channel space in the periphery of the group of tubes arrayed in a relatively concentrated layout, for example, as disclosed in Japanese Patent Application Laid-Open Publication No. 8-226776.

The other measure is to provide a sufficient steam channel in the group of tubes arrayed sparsely as a whole over a broad range, for example, as disclosed in Japanese Patent Publication No. 55-36915.

In a conventional steam condenser, when replacing only the tube group with a new tube group, there is a case that the new group of tubes cannot be easily installed from either an opening part in an operation floor of a turbine building or an opening in a wall thereof. Therefore, it is necessary to construct the tube group in a block structure of blocks each having a size small enough to carry in. However, when constructing such a separable tube group, a problem arises in a biased steam flow into the tube group which is caused by turbine exhaust flow rate distribution.

In general, the farther from a main turbine shaft the turbine exhaust flowing into a container of a steam condenser is, the faster the flow rate is. The closer to the main turbine shaft the exhaust is, the slower the flow rate is. Therefore, of a steam flow introduced from an upper part of the steam condenser to a lower part thereof, the flow is fastest along a side wall of the container of the steam condenser.

Therefore, the tube group may be constructed to be separable, and plural inundation prevention plates for receiving condensed water may be provided in flow channels and the tube group, as a countermeasure against inundation (lowered heat transference caused by drops of condensed water). Besides, in this case, low-pressure parts may occur locally or steam may flow reversely to the outside from the inside of the tube group because of steam having a high flow rate in flow channels along the inundation prevention plates. Consequently, the performance of the steam condenser may deteriorate due to accumulation of gas or increase of pressure loss which is caused by occurrence of localized stagnancy.

A steam condenser condensing steam exhausted from a steam turbine according to an embodiment of the present invention comprises: a container having at least two side walls, configured to let the steam flow down therein from the steam turbine; plural heat transfer tubes arrayed below the steam turbine in the container, letting a cooling medium flow inside, contacting the steam flowing down to condense the steam, extending horizontally, and grouped into at least two upper heat transfer tube groups and at least two lower heat transfer tube groups, the two upper heat transfer tube groups being arranged horizontally with a gap therebetween, the two lower heat transfer tube groups being arranged horizontally with a gap therebetween below the two upper tube groups, and each of the heat transfer tube groups including the plural heat transfer tubes arrayed in a grid; plural tube plates supporting the plural heat transfer tubes; a baffle plate provided at a lower position between the lower heat transfer tube groups and extending in a horizontal direction, to obstruct a flow of steam; an inter-tube-group inundation prevention plate disposed at a position between the upper heat transfer tube groups and the lower heat transfer tube groups opposed vertically to each other, the plate extending in a horizontal direction to guide condensed water flowing down from upside, in a horizontal direction; an enclosure part disposed in each of the heat transfer tube groups, the enclosure part having top plate and two side plates, the top plate being disposed so as to extend substantially horizontally in parallel with the heat transfer tubes and having a gas extraction hole, the two side plates extending downward from the top plate and also extending in parallel with the heat transfer tubes with a space between each other, with the gas extraction hole and the plural heat transfer tubes interposed therebetween; and a gas extraction duct connected to the gas extraction hole to guide gas from the enclosure part to outside of the container.

A steam condenser condensing steam exhausted from a steam turbine according to another embodiment of the present invention comprises: A steam condenser condensing steam exhausted from a steam turbine, the steam condenser comprising: a container having at least two side walls, configured to let the steam flow down from the steam turbine; plural heat transfer tubes arrayed below the steam turbine in the container, letting a cooling medium flow inside, contacting the steam flowing down to condense the steam, extending horizontally, and grouped into at least two upper heat transfer tube groups and at least two lower heat transfer tube groups, the two upper heat transfer tube groups being arranged horizontally in the container with a gap therebetween, the two lower heat transfer tube groups being arranged horizontally with a gap therebetween below the two upper tube groups, and each of the heat transfer tube groups including the plural heat transfer tubes arrayed in a grid; plural tube plates supporting the plural heat transfer tubes; a baffle plate provided at a lower position between the lower heat transfer tube groups and extending in a horizontal direction, to obstruct a flow of steam; an inter-tube-group inundation prevention plate disposed at a position between the upper heat transfer tube groups and the lower heat transfer tube groups opposed vertically to each other, and extends in a horizontal direction to guide condensed water flowing down from upside, in a horizontal direction; a lower tube group enclosure part disposed in each of the lower heat transfer tube groups, the enclosure part having a first top plate and two side plates, the lower tube group first top plate being disposed so as to extend horizontally in parallel with the heat transfer tubes and having a gas extraction hole, and the two side plates extending downward from the first top plate and also extending in parallel with the heat transfer tubes with a space between each other, with the gas extraction hole and the plural heat transfer tubes interposed therebetween; an upper tube group enclosure part disposed in each of lower ends of the upper heat transfer tube groups at the sides close to the side walls of the container, the upper tube group enclosure part having an outer end plate standing from the inter-tube-group inundation prevention plates along an outer end of the upper heat transfer tube groups and having a gas extraction hole, and a second top plate connected to an upper end of the outer end plate and extending in parallel with the inter-tube-group inundation prevention plates, the plural heat transfer tubes being interposed between the upper tube group enclosure part and the inter-tube-group inundation prevention plates; and a gas extraction duct connected to the gas extraction holes of the first top plate of the lower tube group enclosure part and of the outer end plate of the upper tube group enclosure part, to guide gas from the lower tube group enclosure part and the upper tube group enclosure part to outside of the container.

SUMMARY OF THE INVENTION

The present invention has been made to solve the problems described above, and has an object of providing a steam condenser which is compact, presents good performance, and is constructed in a separable tube group structure, which is capable suppressing pressure loss of steam without stagnation of the steam in a group of tubes even if inundation prevention plates for receiving condensed water are provided, as a countermeasure against inundation, in flow channels and the tube group.

DETAILED DESCRIPTION OF THE INVENTION

[First Embodiment]

Figure 1:
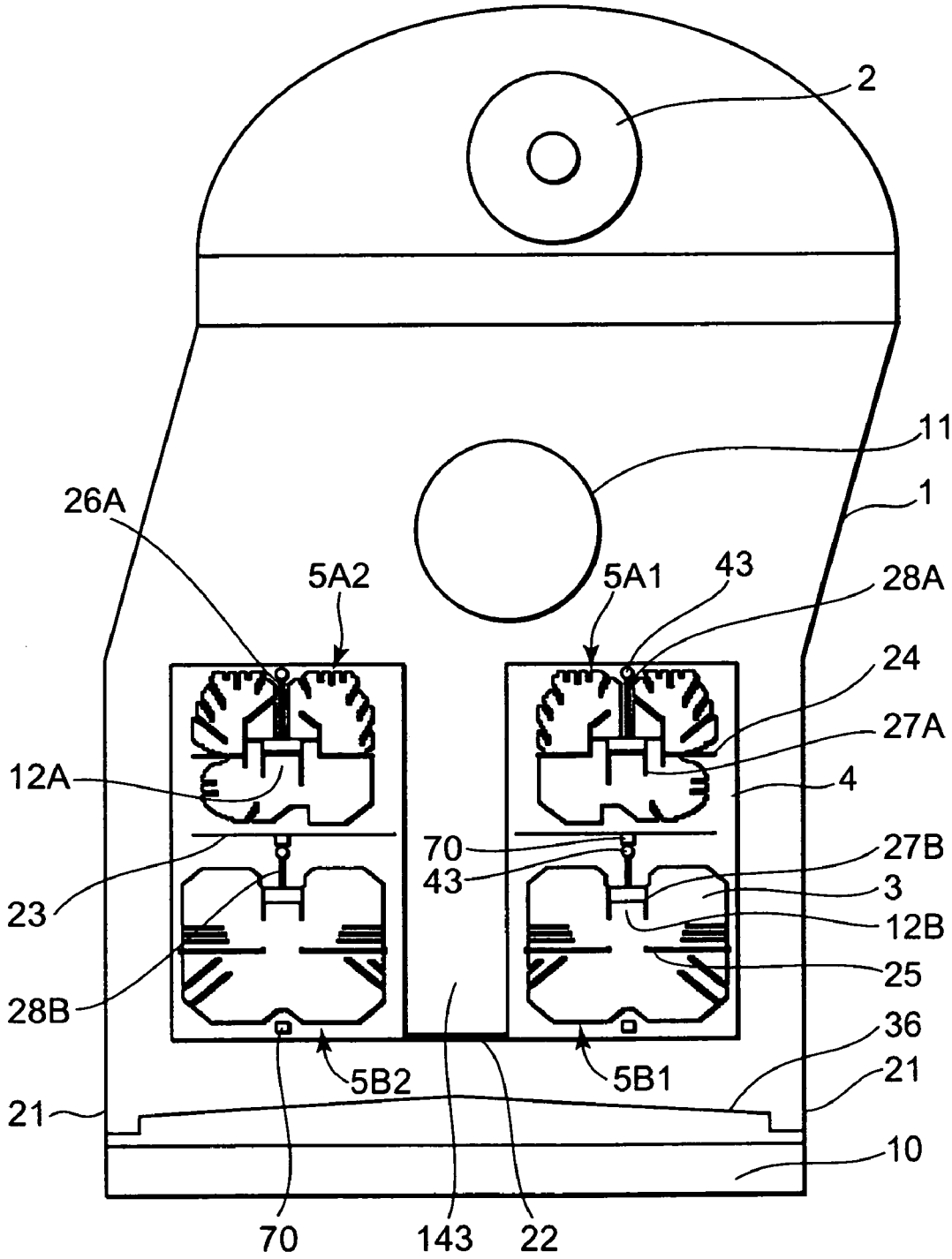
FIG. 1 is a front vertical cross-sectional view showing a steam condenser according to a first embodiment of the present invention.
Figure 2:
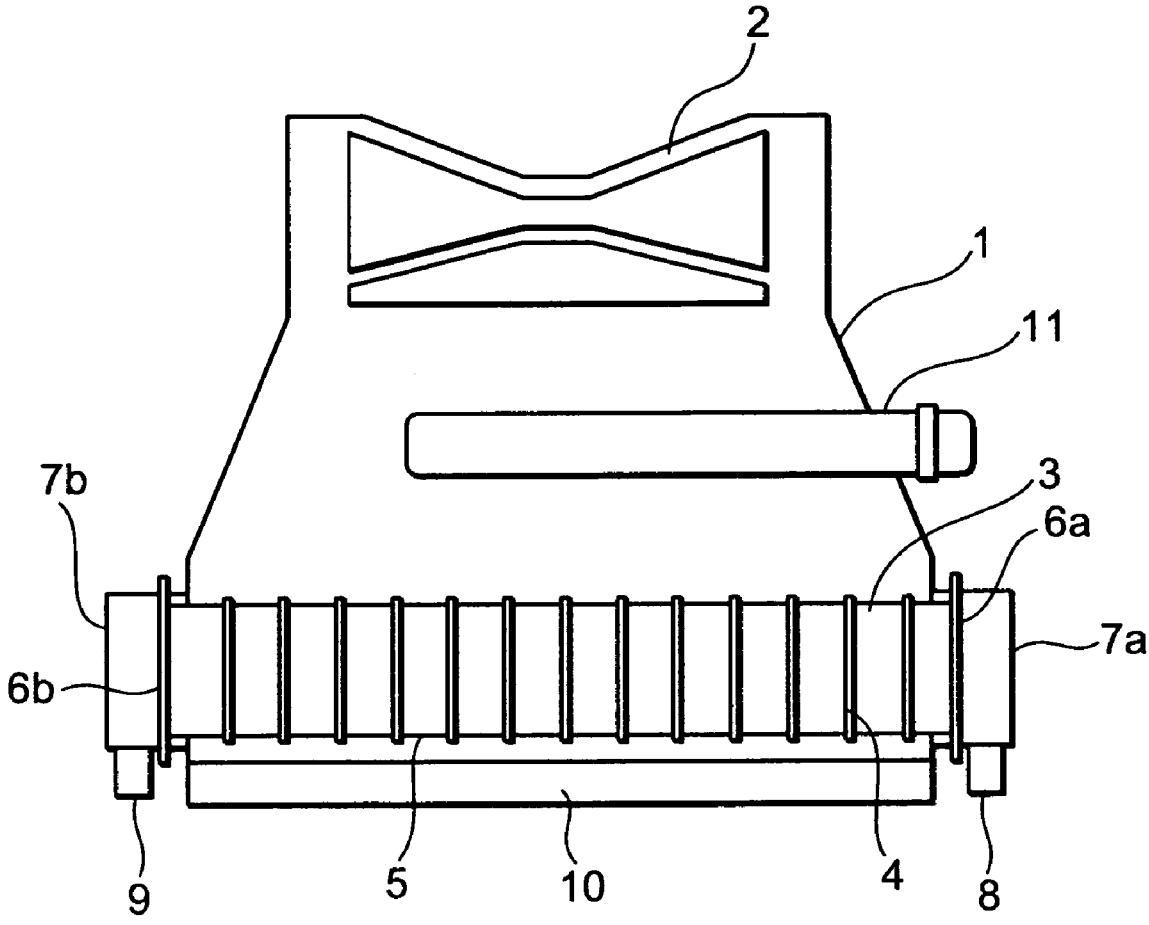
FIG. 2 is a side vertical cross-sectional view showing the steam condenser shown in FIG. 1.
Figure 3:
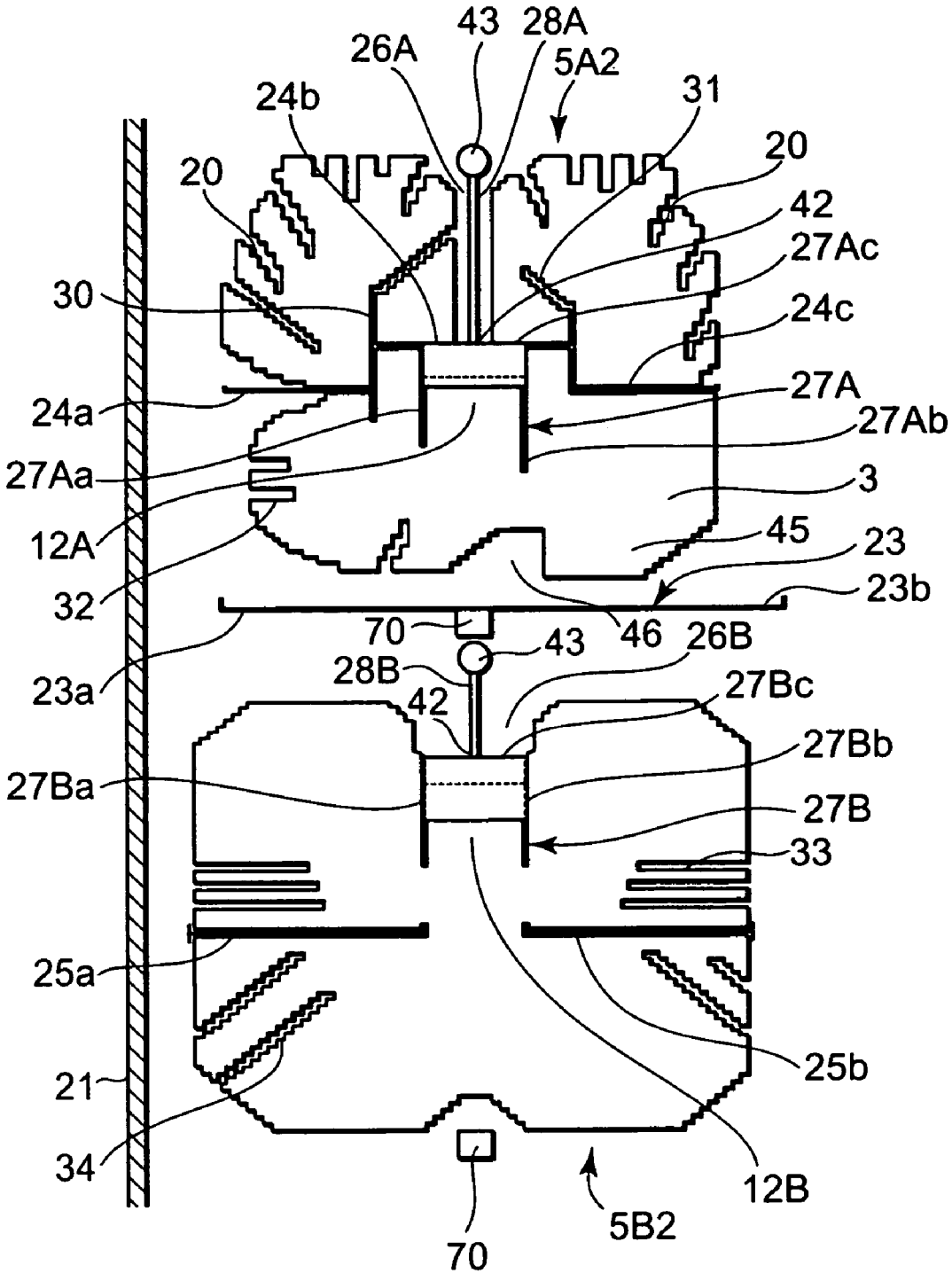
FIG. 3 is a front vertical cross-sectional view showing heat transfer tube groups in the steam condenser shown in FIG. 1.
Figure 4:
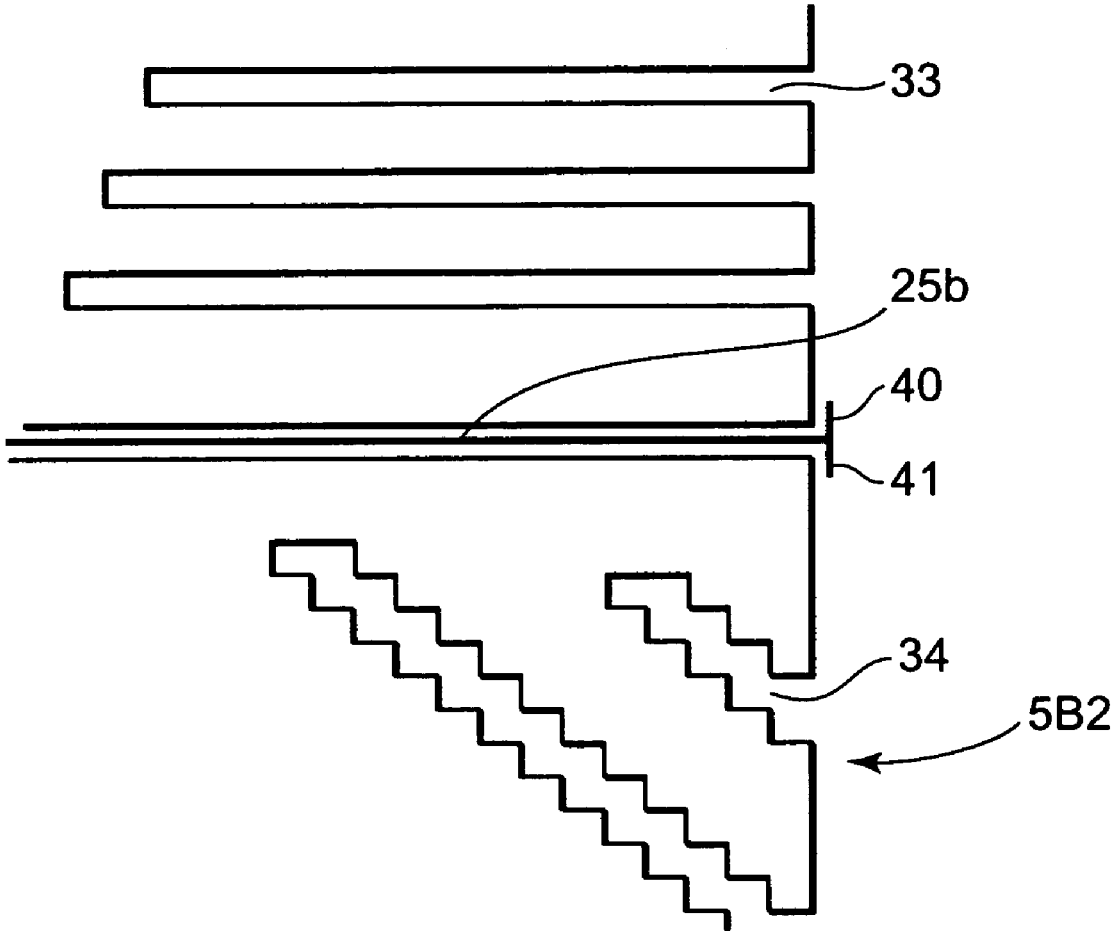
FIG. 4 is an enlarged front vertical cross-sectional view showing a main part of the heat transfer tube group shown in FIG. 1.

The first embodiment of the present invention will now be described with reference to FIGS. 1 to 4. FIG. 1 is a front vertical cross-sectional view of a steam condenser according to the first embodiment of the present invention. FIG. 2 is a side vertical cross-sectional view thereof. FIG. 3 is an enlarged front view showing a tube group part in FIG. 1. FIG. 4 is an enlarged front view of the area of an inundation prevention plate end in a lower tube group.

The steam condenser according to the present embodiment has a container 1 having a substantially rectangular plan view, as shown in FIGS. 1 and 2. A steam turbine 2 whose axis is arranged horizontally is set at an upper part in the container 1.

At a lower part inside the container 1, a large number of heat transfer tubes 3, e.g., twenty to thirty thousand tubes 3 are arrayed, like a grid, in a direction parallel to the axis of the turbine 2. The heat transfer tubes 3 are arranged in inline grids or staggered grids. The heat transfer tubes 3 are supported and fixed by plural support plates 4 which are arranged at a predetermined interval in the lengthwise direction thereof. The heat transfer tubes 3 constitute four tube groups 5 (5A1, 5A2, 5B1, and 5B2). The support plates 4 are supported horizontally by a beam 70 parallel to the heat transfer tubes 3.

Both ends of each heat transfer tube 3 extending in the lengthwise direction thereof are fixed to tube plates **6*a* and 6*b*** extending in the vertical direction. In those sides of the tube plates 6*a* and 6*b* that are opposite to the heat transfer tubes 3, water chambers 7*a* and 7*b* each communicating with plural heat transfer tubes 3 are provided. An inlet port 8 for cooling water (ordinarily seawater or cooling tower water) as a cooling medium is provided for the water chamber 7*a*, and an outlet port 9 for cooling water is provided for the water chamber 7*b* in the opposite side. At the bottom of the container 1, a hotwell (condensed water reservoir) 10 is provided below the tube groups 5. A hotwell cover 36 is provided over the hotwell 10.

There may be a case that a feed-water heater 11 is provided at an upper part inside the container 1 in a steam condenser in a large-scale power plant, in order to save the layout space and simplify the piping.

In the steam condenser having a structure described above, steam of high temperature flows out of the steam turbine 2 down in the container 1 toward the tube groups 5. Steam which has reached the surfaces of the tube groups 5 contacts there the heat transfer tubes 3, and exchanges heat with the cooling water flowing inside the heat transfer tubes 3. The water flows into the heat transfer tubes from the water chamber 7*a*. The steam is deprived of the latent heat, so that the steam is condensed and collected as condensed water in the hotwell 10 disposed at the bottom of the container 1.

On the other side, the cooling water which has obtained heat from the steam is discharged from a cooing water outlet 9 through the water chamber 7*b* in the other ends of the heat transfer tubes 3. The cooling water is then returned to the sea or the like.

Thus, as the high temperature steam flown out of the steam turbine 2 passes though the tube groups 5, latent heat is deprived and the steam is gradually condensed. At this time, some steam and noncondensable gas are left not condensed. The noncondensable gas includes small amount of air which has been contained in the steam. The concentration of the noncondensable gas gradually increases along the flow passage of the steam in the tube groups 5.

Therefore, steam containing noncondensable gas at high density is guided to a gas cooling section 12. In this section, the steam is further condensed such that the noncondensable gas density is raised as much as possible. Afterwards, the noncondensable gas is extracted out of the container 1 through gas extraction ducts 28A and 28B by a vacuum pump not shown.

Details of the tube groups 5 will now be described. The tube groups 5 of heat transfer tubes 3 are divided into two upper tube groups 5A1 and 5A2, and two lower tube groups 5B1 and 5B2. The upper tube groups 5A1 and 5A2 are arranged at an equal height with a gap between each other. The lower tube groups 5B1 and 5B2 are respectively provided below the upper tube groups 5A1 and 5A2. The two upper tube groups 5A1 and 5A2 and the two lower tube groups 5B1 and 5B2 are arranged symmetrically with respect to the center of the container 1 as a symmetry plane. Layouts of the heat transfer tubes 3 in the tube groups 5 are symmetrical with respect to the same symmetry plane. A central steam channel 143 extending in a vertical direction is formed between the upper tube groups 5A1 and 5A2 and between the lower tube groups 5B1 and 5B2.

As shown in FIG. 1, the support plates 4 which support and fix the heat transfer tubes 3 may be constituted by a set of support plates 4 which support, in common, the upper tube group 5A1 and lower tube group 5B1 arranged vertically, and another set of support plates 4 which also support, in common, the upper tube group 5A2 and the lower tube group 5B2. Alternatively, the support plates 4 may be constituted as a set of integral units.

A baffle plate 22 extending horizontally is provided so as to shut up a plane connecting lower ends of the lower tube groups 5B1 and 5B2, i.e., so as to close the lower end of the center steam channel 143. The lower ends of the lower tube groups 5B1 and 5B2 and the lower surface of the baffle plate 22 are positioned higher than the upper surface of the hotwell cover 36. Also, the upper tube groups 5A1 and 5A2 and the lower tube groups 5B1 and 5B2 are disposed apart from the side wall 21 of the container 1.

FIG. 3 shows only the tube groups 5A2 and 5B2 arranged in one column. The tube groups 5A1 and 5B1 arranged in another column are plane-symmetrical to the tube groups 5A2 and 5B2, and therefore, illustrations and a description thereof will be omitted.

An inter-tube-group inundation prevention plate 23 arranged horizontally along the lengthwise direction of the heat transfer tubes 3 is provided at each of substantial centers between the upper tube group 5A1 and the lower tube group 5B1 and between the upper tube group 5A2 and the lower tube group 5B2.

The inter-tube-group inundation prevention plates 23 each are arranged such that a part 23*b* of each plate at the side of the center steam channel 143 is longer than the rest part 23*a* thereof at the side of the side wall 21 of the container 1.

The part 23*b* at the side of the center steam channel 143 is longer toward the centerline of the turbine exhaust port than the end part of the upper tube group 5A2. The part 23*a* at the side of the side wall 21 aligns with the end of the upper tube group 5A2 or longer than the end part of the upper tube group 5A2. The-protrusion of the part 23*a* at the side of the side wall 21 is shorter than the protrusion of the 23*b* at the side of the center steam channel 143.

Upper collars 40 extending in the lengthwise direction of the heat transfer tubes 3 are formed at both ends of the inter-tube-group inundation prevention plate 23.

As shown in FIG. 3, three inundation prevention plates 24*a*, 24*b*, and 24*c* are provided inside the upper tube group 5A2. Two inundation prevention plates 25*a* and 25*b* are provided inside the lower tube group 5B2. These inundation prevention plates each are arranged horizontally, and have ends provided with the colors 40 extending in the lengthwise direction of the heat transfer tubes 3.

The outer inundation prevention plates 24*a* and 24*c* in the upper tube group 5A2 are provided substantially at an equal height. The central inundation prevention plate 24*b* is provided at a higher position than those plates 24*a* and 24*c*. The inundation prevention plates 25*a* and 25*b* in the lower tube group 5B2 are provided substantially at an equal height, and a gap is formed therebetween.

The positions of the inundation prevention plates 25*a* and 25*b* in the lower tube group 5B2 are preferably higher than the center of the lower tube group 5B2.

As shown in FIG. 4, upper collars 40 extending in the lengthwise direction of the heat transfer tubes 3 are formed at outer ends of the inundation prevention plates 25*a* and 25*b* in the lower tube group 5B2. In addition, lower collars 41 extending opposite to the upper collars 40 are formed at these outer ends. The outer ends of the inundation prevention plates 25*a* and 25*b* each have a T-shape as a whole.

As shown in FIG. 3, a steam channel 26A extending in the lengthwise direction and in the vertical direction of the heat transfer tubes 3 is formed at an upper center of the upper tube group 5A2. An enclosure part 27A extending in the lengthwise direction of the heat transfer tubes 3 and open to the downside is formed at an outlet part (lower end) of the steam channel 26A. The enclosure part 27A has of an upper plate 27Ac, an outer plate 27Aa, and an inner plate 27Ab. The upper plate 27Ac is provided horizontally, extending in the lengthwise direction of the heat transfer tubes 3. The outer and inner plates 27Aa and 27Ab extend downward in the lengthwise direction of the heat transfer tubes 3 from both ends of the upper plate 27Ac. The outer plate 27Aa is close to the side wall 21 of the container 1 while the inner plate 27Ab is close to the center steam channel 143. The inner plate 27Ab extends to be longer in the downside than the outer plate 27Aa.

Plural heat transfer tubes 3 are provided between the outer and inner plates 27Aa and 27Ab, forming a gas cooling section 12A. Gas extraction holes 42 as through holes are formed in the upper plate 27Ac of the enclosure part 27A. Gas extraction ducts 28A are connected above the gas extraction holes 42. The gas extraction ducts 28A extend vertically inside the steam channel 26A, and are connected to a gas collection tube 43 which extends in the lengthwise direction of the heat transfer tubes 3. The gas collection tube 32 is connected to a vacuum device not shown but provided outside the container 1.

The enclosure part 27A formed in the upper tube group 5A2 is preferably provided substantially at the center in the height direction of the upper tube group 5A2.

In the lower tube group 5B2, a steam channel 26B is formed at the center of an upper part of the tube group, like the upper tube group 5A2. An enclosure part 27B open to the downside is provided at an outlet part (lower end) of the steam channel 26B. The enclosure part 27B consists of an upper plate 27Bc, outer plate 27Ba, and inner plate 27Bb. The outer and inner plates 27Ba and 27Bb extend downward from both ends of the upper plate 27Bc. The outer and inner plates 27Ba and 27Bb have substantially equal sizes.

The enclosure part 27B formed in the lower tube group 5B2 are preferably provided at a position within 25% from the top of the length of lower tube group 5B2 in the height direction.

The gas extraction duct 8B and the gas collection tube 43 in the lower tube group 5B2 have the same structures as those in the upper tube group 5A2.

The number of heat transfer tubes 3 in the lower tube groups 5B1 and 5B2 is greater than the number of heat transfer tubes 3 in the upper tube groups 5A1 and 5A2.

In the periphery of an upper part of the upper tube group 5A2, plural outer lanes 20 in which steam passes obliquely downward from the outside toward the inside are formed. In the periphery of a lower part of the lower tube group 5B2, plural outer lanes 34 in which steam passes obliquely upward from the outside toward the inside are formed.

Here, a "lane" is a steam passage formed in a heat transfer tube group where one or more arrays of heat transfer tubes are removed from the grid like a slit in the grid.

In a part of the upper tube group 5A2 above the horizontal inundation prevention plate 24*a* provided in the upper tube group 5A2, a first inner lane 30 is provided. The first inner lane 30 communicates with the steam channel 26A and extends to the downside of the inundation prevention plate 24*a*. In a part of the upper tube group 5A2 above the inundation prevention plate 24*c*, a second inner lane 31 is provided. The second inner lane 31 extends to the downside of the inundation prevention plate 24*c* from the middle of the part of the tube group above the inundation prevention plate 24*c*. These inner lanes 30 and 31 each are a channel for steam.

At the lower end of the upper tube group 5A2, at least one horizontal array of the heat transfer tubes 3 are protruded downward at the side close to the center steam channel 143, forming a protruding part 45. The position of the protruding part 45 is closer to the center steam passage 143 than the inner plate 27Ab of the enclosure part 27A in the upper tube group 5A2. A large concave 46 is formed closer to the side wall 21 of the container 1 next to the protruding part 45.

The outer shape of the tube group facing the side wall 21 of the container 1 above the inundation prevention plate 24*a* in the upper tube group 5A2 is jagged like leaves, for every outer lane 20. The inundation prevention plate 24*a* is provided to be longer than the shortest surface of the jags of the tube group.

The outer shape of a part of the upper tube group 5A2 below the inundation prevention plate 24*a* is semi-circular, swelling toward the side wall 21 of the container 1. A second outer lane 32 extending horizontally to the inside from a position facing to the side wall 21 of the container 1 is provided.

Above the inundation prevention plates 25*a* and 25*b* in the lower tube group 5B2, plural horizontal first outer lanes 33 which communicate with an external channel are provided. Below the inundation prevention plates 25*a* and 25*b*, second outer lanes 34 which communicate with an external channel are provided along a line at an angle of 60°.

In this case, both of the first and second outer lanes 33 and 34 are preferably provided to be as deep as about ¼ of the lateral width of the lower tube group 5B2.

Protection tubes arrayed in plural columns which do not function to condense steam are provided in the outer periphery of the upper surface of the upper tube group 5A2, the outer periphery thereof facing the side wall 21 of the container 1, and the outer periphery of the lower tube group 5B2 facing the side wall 21 of the container 1.

Further, the steam condenser is operated such that the internal pressure (the internal pressure of the gas cooling part) inside the enclosure parts 27A and 27B opened downward and provided in the upper tube groups 5A1 and 5A2 and the lower tube groups 5B1 and 5B2 is set to be relatively low in the upper tube groups 5A1 and 5A2 while this pressure is relatively high in the lower tube groups 5B1 and 5B2. This pressure setting is achieved by providing appropriate orifices in the gas extraction duct 28A and 28B provided in the sides opposite to the opening parts of the enclosure parts 27A and 27B.

In the steam condenser according to the first embodiment of the present invention as described above, a baffle plate 22 is provided along the lengthwise direction of the heat transfer tubes 3 below the lower tube groups 5B1 and 5B2, among the four tube groups 5A1, 5A2, 5B1, and 5B2. The exhausted steam from the turbine 2 flows downward along the side wall 21 of the container 1. However, owing to the baffle plate 22, it is possible to suppress a swirling flow of steam which would flow toward the center of the container 1 between the hotwell cover 36 and the lower tube groups 5B1 and 5B2 and then upward inside the center steam channel 143. Accordingly, pressure loss of steam can be reduced. originally, the flow of steam would be faster near the wall of the container 1. If the baffle plate 22 is not provided, a swirling flow as described above would occur and increase the pressure loss.

Between the upper tube groups 5A1 and 5A2 and the lower tube groups 5B1 and 5B2, inter-tube-group inundation prevention plates 23 are provided. The inter-tube-group inundation prevention plates 23 have sizes equal to or longer than the lowermost surfaces of the upper tube groups 5A1 and 5A2, and ends provided with upper collars 40. Further, inundation prevention plates 24*a* to 24*c* are provided in each of the upper tube groups 5A1 and 5A2. Inundation prevention plates 25*a* and 25*b* are provided in each of the lower tube groups 5B1 and 5B2. Therefore, it is possible to restrict lowering of the heat transmission efficiency due to inundation or flowing down of water condensed in the tube groups 5A1, 5A2, 5B1, and 5B2.

On the surfaces of the inter-tube-group inundation prevention plates 23, a large volume of steam flows and forms a high-speed flow because of biased flow rate distribution of the turbine 2. This flow draws steam from the upper tube groups into the flow passages, due to viscosity of fluid. However, the gas cooling parts 12A in the upper tube groups 5A1 and 5A2 are arranged substantially at the centers of these upper tube groups 5A1 and 5A2, respectively, so that parts of the tube groups below the gas cooling parts 12A are thickened. In each of the gas cooling parts 12A forming part of the upper tube groups 5A1 and 5A2, the outer plate 27Aa of the enclosure part 27A which surrounds the gas cooling part 12A is shorter than the inner plate 27Ab thereof. Therefore, the force which draws steam due to condensation in the upper tube group 5A1 increases so that noncondensable gas can be guided smoothly to the gas cooling part 12A.

On the other hand, in the lower tube groups 5B1 and 5B2, the positions of the gas cooling parts 12B are arranged above the centers of the lower tube groups 5B1 and 5B2. Therefore, the positions of the gas cooling parts 12B are close to the locations having the lowest pressure in the areas of the lower tube groups 5B1 and 5B2. Accordingly, noncondensable gas can be smoothly guided to the gas cooling parts 12B without stagnancy.

In parts of tube groups where stagnancy is easily caused, between the inundation prevention plates 24*a* in the upper tube groups 5A1 and 5A2 and the inter-tube-group inundation prevention plates 23, the tube groups have small sizes and semi-circular outer shapes. Outer lanes 32 as horizontal steam channels are provided, extending from the side wall 21 of the container 1. These features contribute to improved efficiency of leading smoothly noncondensable gas to the gas cooling parts 12B without stagnancy.

Each of the upper tube groups 5A1 and 5A2 is provided with plural outer lanes 20 and 32 in the peripheries of these groups themselves, and is also provided internally with a first inner lane 30 which communicates with the steam channel 26A and extends to the downside of the inundation prevention plate 24*a*. The second inner lane 31 which extends from the middle of the tube group to the downside of the inundation prevention plate 24*c* is provided above the inundation prevention plate 24*c*. Therefore, steam can be easily taken into the upper tube groups 5A1 and 5A2 from the steam channel 26A, so that steam can be smoothly fed downward from the upside of the upper tube groups 5A1 and 5A2.

Further, in each of the lower tube groups 5B1 and 5B2, outer lanes 33 and 34 are provided respectively above and below the two horizontal inundation prevention plates 25*a* and 25*b*. Therefore, noncondensable gas can be guided smoothly to the gas cooling parts 12B.

Further, a protruding part 45 where plural horizontal columns protrude downward at the side close to the center of the container 1 is formed at each of the lowermost ends of the upper tube groups 5A1 and 5A2. At another side close to the side wall 21, a large concave 46 is provided in the lower end of the container 1 of each of the lower tube groups 5B1 and 5B2. Therefore, flows of steam in the tube groups which tend to be drawn by high-speed flows along the upper surfaces of the inter-tube-group inundation prevention plates 23 can be controlled to become an upward flow. Accordingly, noncondensable gas can flow smoothly into the gas cooling parts 12A.

Also, the inundation prevention plates 24*a* in the upper tube groups 5A1 and 5A2 protrude outward beyond the outer circumferences of parts of the tube groups above the plates. Therefore, the volume of steam flowing from upside of the inundation prevention plates 24*a* into the upper tube groups 5A1 and 5A2 can be increased. This results in an effect that swirls which tend to occur below the inundation prevention plates 24*a* can be suppressed.

Further, in each of the inter-tube-group inundation prevention plates 23, the part 23*b* which is closer to the center line of a turbine exhaust port horizontally protrudes to be longer as compared with the part 23*a* at the other side farther from the center line of the turbine exhaust port. Therefore, it is possible to uniformalize unbalanced flow rate of steam which flows in along the inter-tube-group inundation prevention plates 23 due to horizontal misalignment between the main shaft of the turbine and the center line of the steam condenser container 1.

Also, the inundation prevention plates 25*a* and 25*b* are provided at each of substantial centers of the lower tube groups 5B1 and 5B2 in the height direction. In addition to upper collars 40, lower collars 41 are provided at ends of the inundation prevention plates 25*a* and 25*b* at the channel side, so that each of the inundation prevention plates 25*a* and 25*b* has a T-shape as a whole. Accordingly, it is possible to prevent a large volume of steam from flowing in from channel outside the tube groups bypassing the periphery of heat transfer tubes.

Columns of protection tubes which do not function to condense steam are provided along a part of each of the tube groups 5A1, 5A2, 5B1, and 5B2 that faces the side wall 21 of the container 1 and along the outer circumferences of the upper surfaces of the upper tube groups 5A1 and 5A2. Therefore, tube groups and constructional elements can be prevented from being damaged by water drops accelerated by a high-speed flow from the steam turbine.

The steam condenser is operated such that the pressure inside the enclosure parts 27A and 27B which are open to the downside and provided in the tube groups 5A1, 5A2, 5B1, and 5B2 is set to be relatively low at the enclosure parts 27A in the upper tube groups 5A1 and 5A2 while the pressure is relatively high at the enclosure parts 27B in the lower tube groups 5B1 and 5B2. Therefore, the operation of the steam condenser can coincide with original pressure distribution pattern, i.e., the pressure becomes relatively high at the lower part in the container 1 and relatively low at the upper part in the container 1. Accordingly, noncondensable gas can be efficiently guided to the gas cooling parts 12A and 12*b*.

Even in a work to replace heat transfer tubes with new ones with use of an existing container 1, each separated tube group can be integrally installed either from an opening part in the operation floor of a turbine building or an opening in a wall thereof because the heat transfer tubes are divided into plural tube groups. Accordingly, the replacement work can be easily carried out.

[Second Embodiment]

Next, the second embodiment of the present invention will be described with reference to FIG. 5. In the following description of the present embodiment, those components that are identical or similar to components in the first embodiment will be denoted at identical reference symbols. Repetitive descriptions of those components will be omitted.

Figure 5:
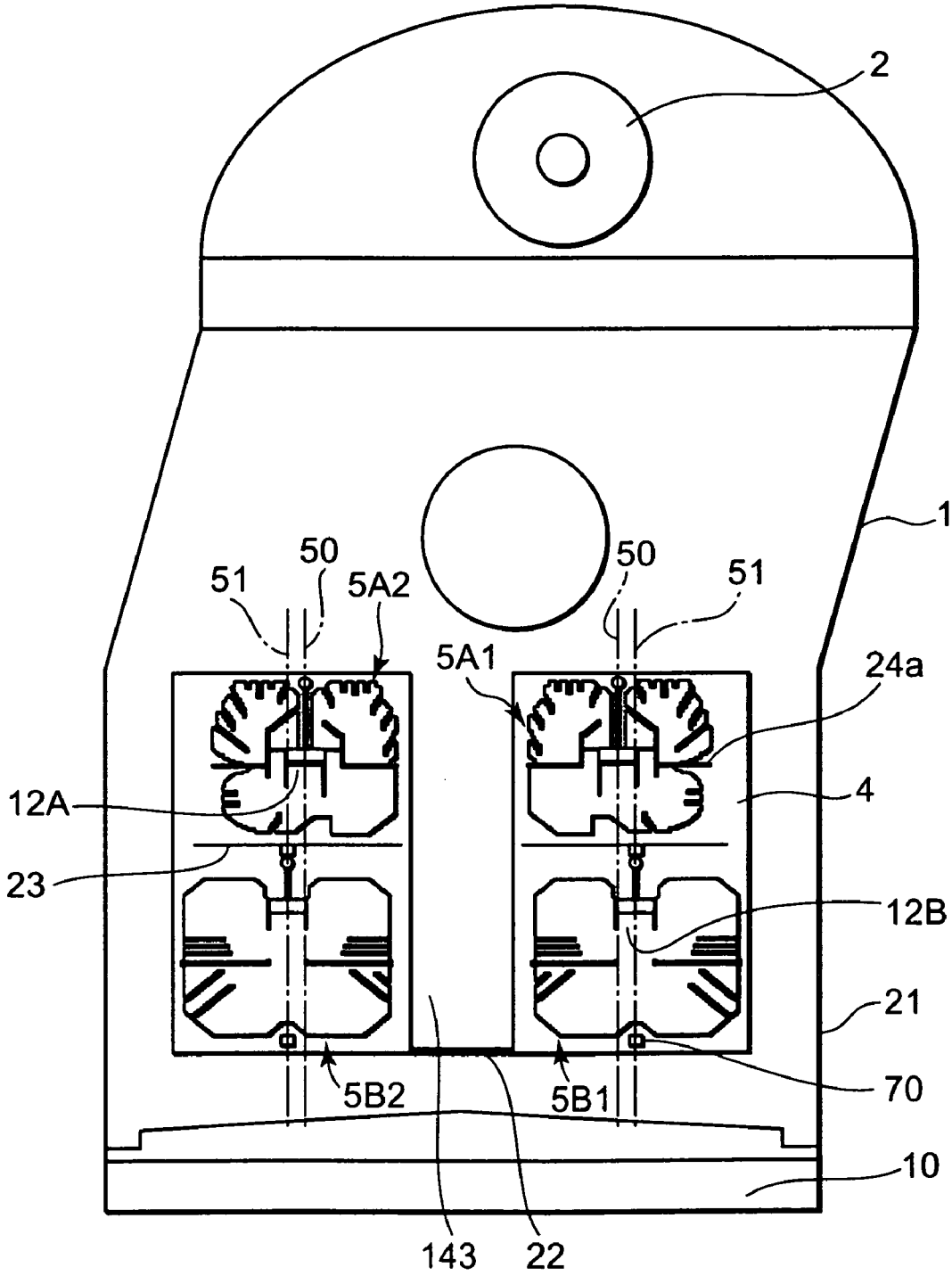
FIG. 5 is a front vertical cross-sectional view showing a steam condenser according to a second embodiment of the present invention.

As shown in FIG. 5, the center lines 50 of the upper tube groups 5A1 and 5A2 are closer to the center of the container 1 than the center lines 51 of the lower tube groups 5B1 and 5B2, respectively.

In the present embodiment, the widths of channels along the side wall 21 of the container 1, through which high-speed flows of turbine exhaust pass, are wider particularly at positions in the sides of the upper tube groups 5A1 and 5A2. Therefore, stagnancy which tends to occur between the inter-tube-group inundation prevention plates 23 and the inundation prevention plates 24*a* in the upper tube groups 5A1 and 5A2 can be suppressed. Accordingly, steam can be guided smoothly to the gas cooling parts 12A and 12B.

[Third Embodiment]

Figure 6:
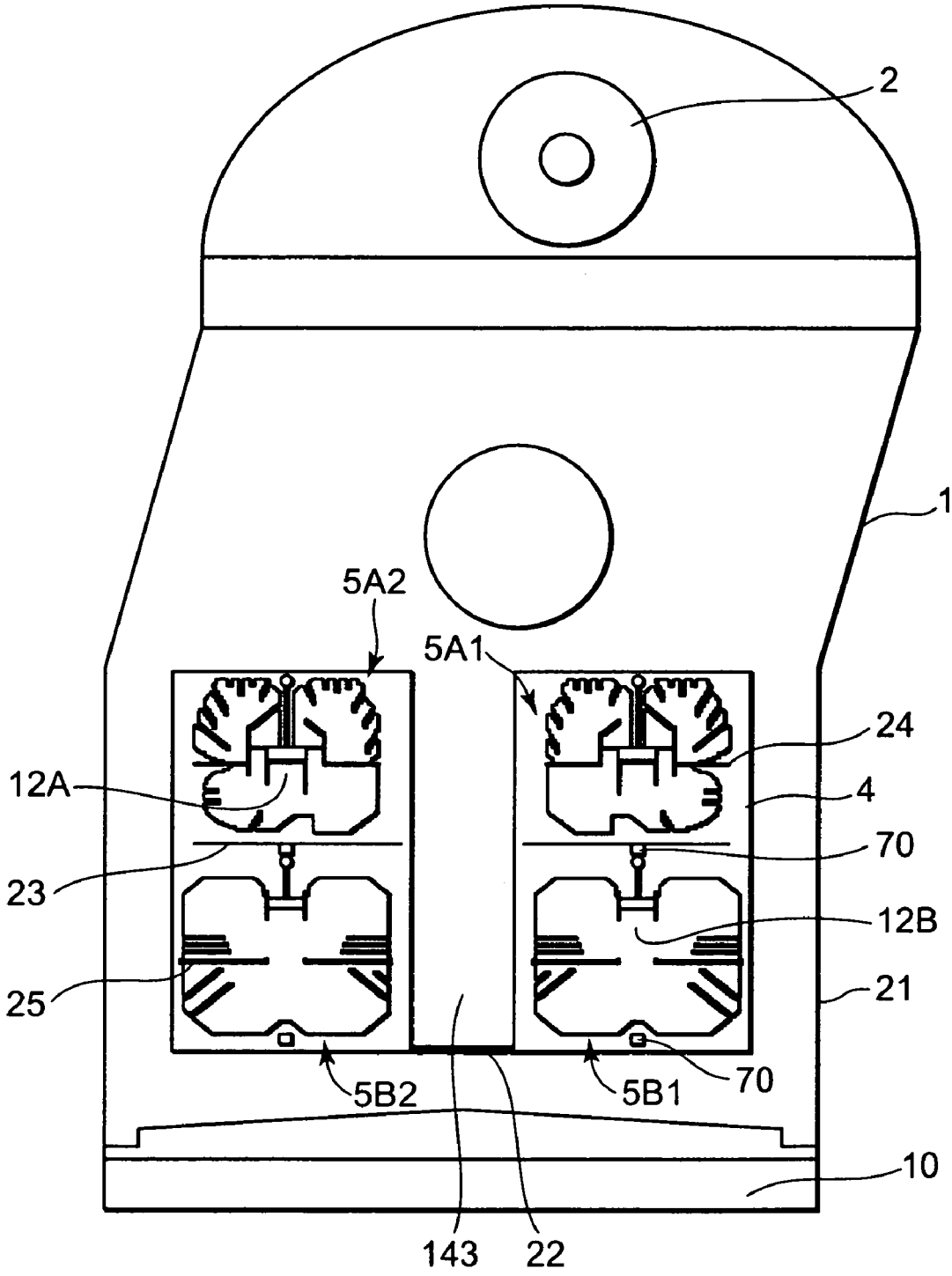
FIG. 6 is a front vertical cross-sectional view showing a steam condenser according to a third embodiment of the present invention.

Next, the third embodiment of the present invention will be described with reference to FIG. 6. In this embodiment, the gas cooling parts 12B in the lower tube groups 5B1 and 5B2 are provided at positions higher than those of the first embodiment. Preferably, these cooling parts 12B are positioned to be within 10% of the height of the lower tube groups 5B1 and 5B2 from the top of these tube groups.

According to the present embodiment, the distance between the gas cooling parts 12B of the lower tube groups 5B1 and 5B2 and the inundation prevention plates 25 in the lower tube groups 5B1 and 5B2 is long. Therefore, stagnancy which tends to occur between the inundation prevention plates 25 and the gas cooling parts 12B can be suppressed. Accordingly, noncondensable gas can be guided smoothly to the gas cooling parts 12B.

[Fourth Embodiment]

Figure 7:
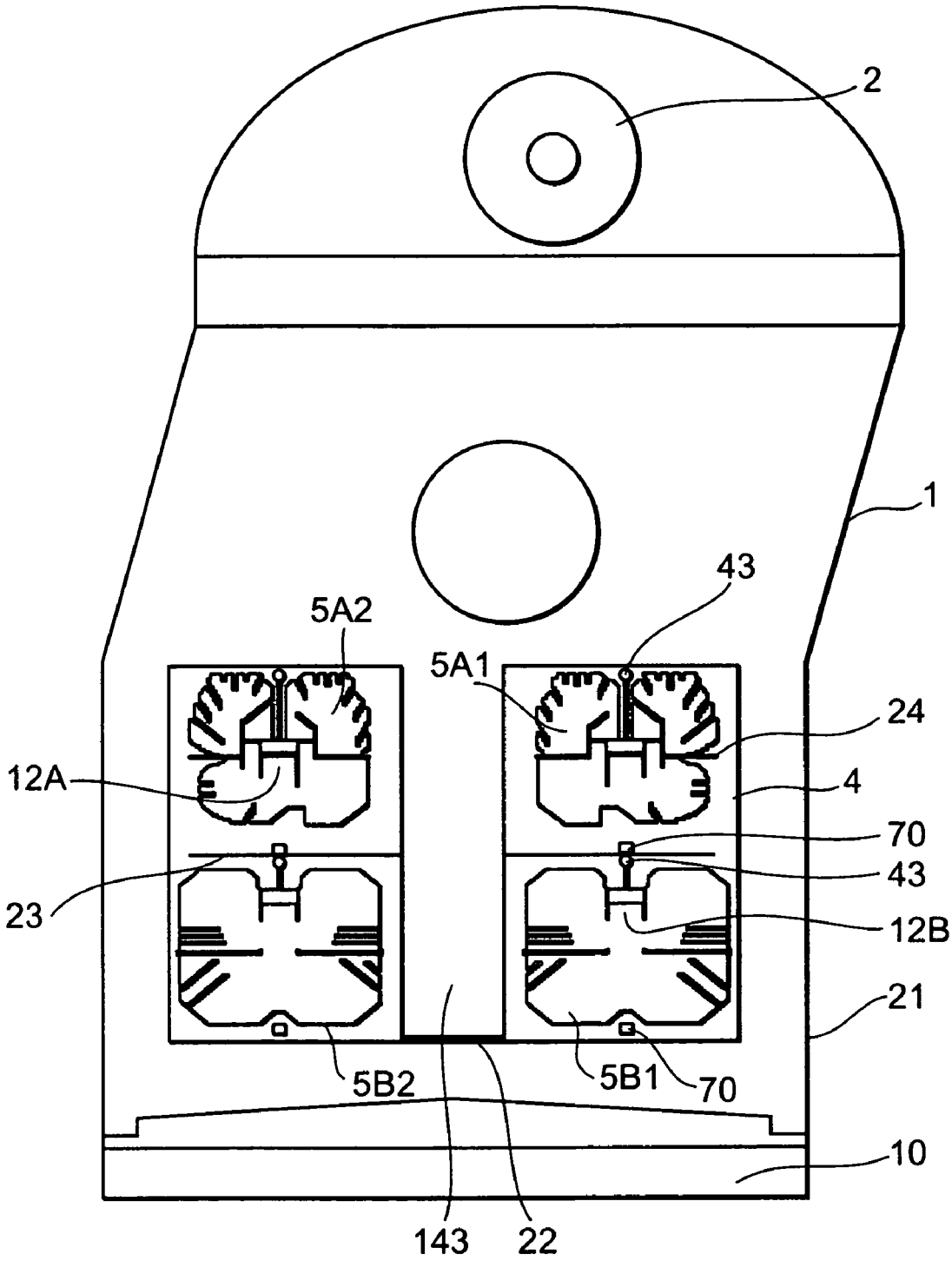
FIG. 7 is a front vertical cross-sectional view showing a steam condenser according to a fourth embodiment of the present invention.

Next, the fourth embodiment of the present invention will be described with reference to FIG. 7. In this embodiment, the inter-tube-group inundation prevention plates 23 are provided at positions lower than those of the first embodiment. Preferably, the inter-tube-group inundation prevention plates 23 are provided below a center line between the upper tube groups 5A1 and 5A2, and the lower tube groups 5B1 and 5B2.

According to the present embodiment, the distance between the lower ends of the upper tube groups 5A1 and 5A2 and the inter-tube-group inundation prevention plates 23 is long. Therefore, the speed of steam flowing above the surfaces of the inter-tube-group inundation prevention plates 23 is relatively low, so that stagnancy which tends to occur in parts of tube groups between the inter-tube-group inundation prevention plates 23 and the inundation prevention plates 24 can be suppressed. Accordingly, noncondensable gas can be guided smoothly to the gas cooling parts 12A.

[Fifth Embodiment]

Figure 8:
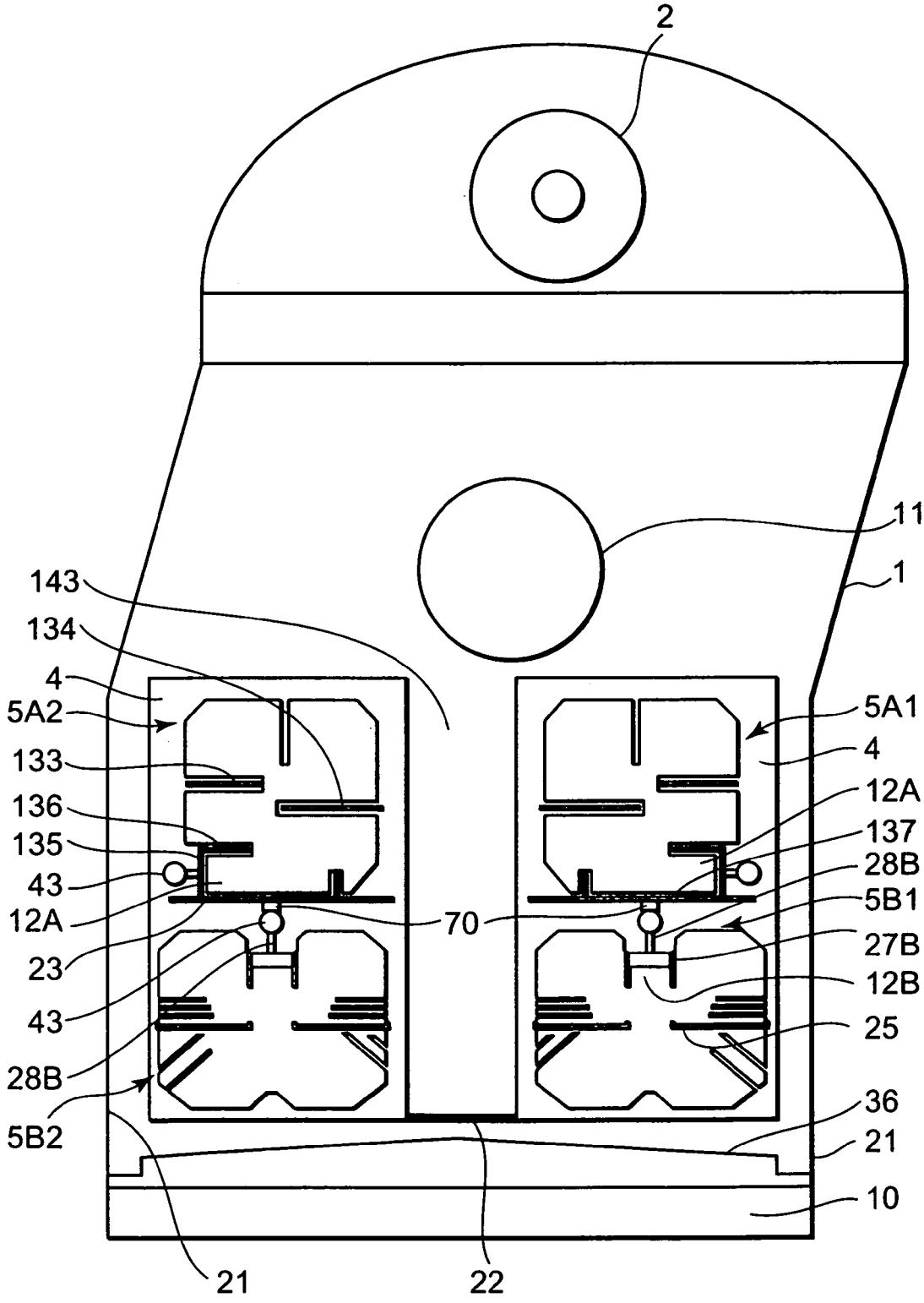
FIG. 8 is a front vertical cross-sectional view showing a steam condenser according to a fifth embodiment of the present invention.
Figure 9:
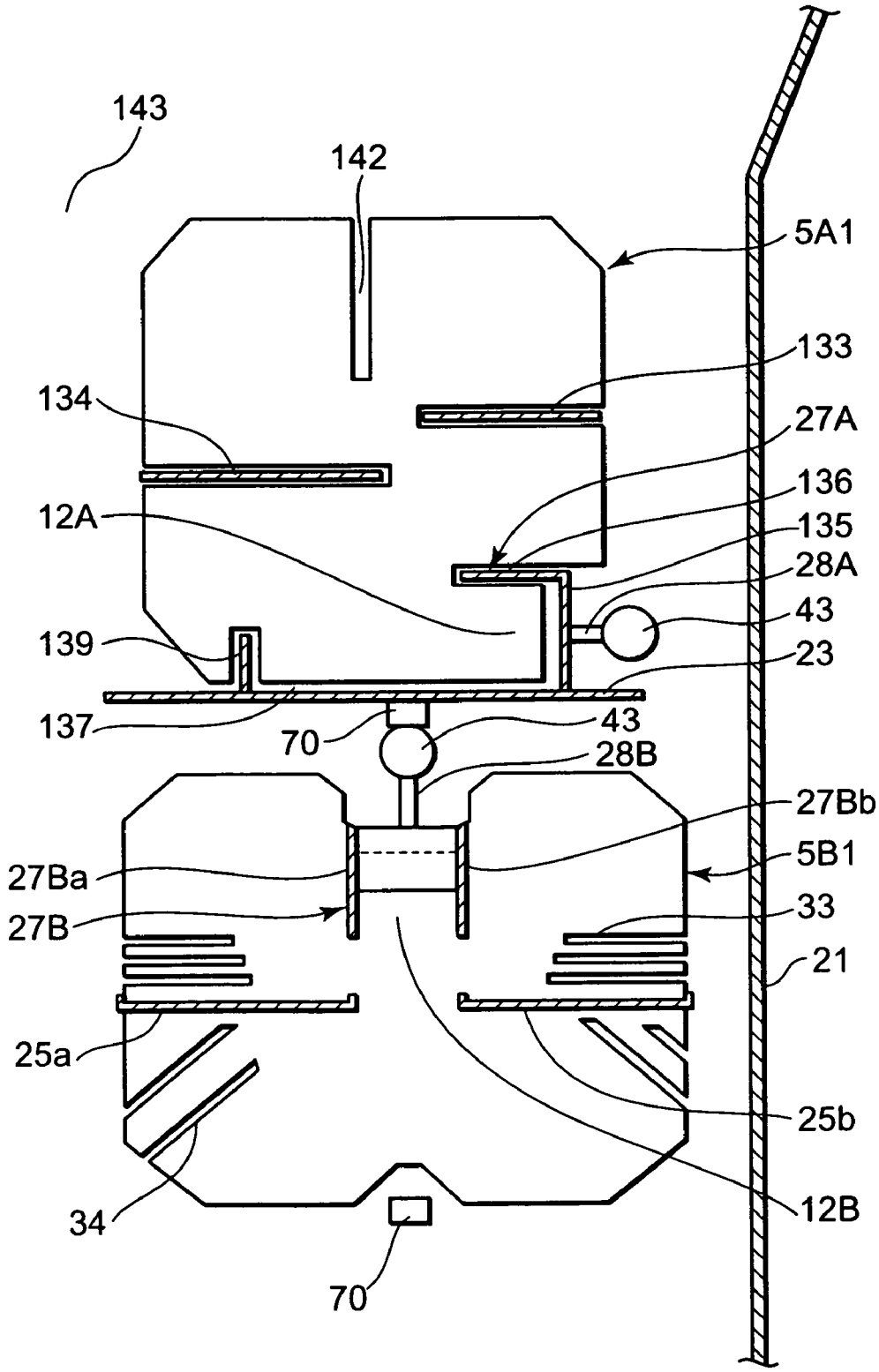
FIG. 9 is a front vertical cross-sectional view showing heat transfer tube groups in the steam condenser shown in FIG. 8.
Figure 10:
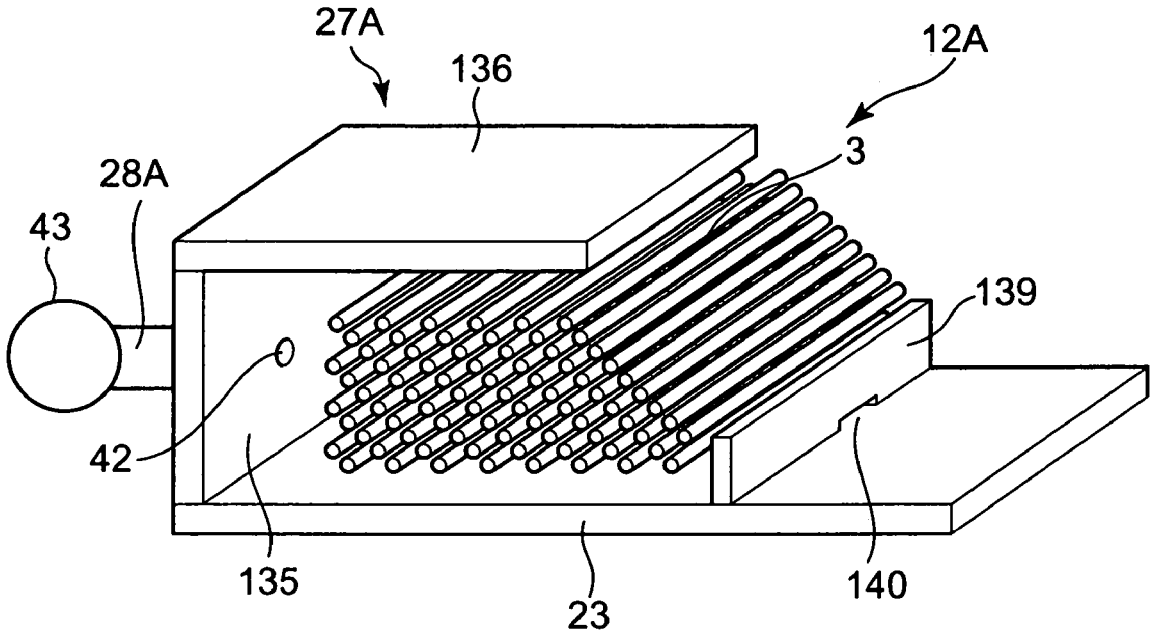
FIG. 10 is an enlarged perspective view showing an area of a gas cooling part in an upper tube group in the steam condenser according to the fifth and sixth embodiments of the present invention.

Next, the fifth embodiment of the present invention will be described with reference to FIGS. 8 to 10. FIG. 8 is a front vertical cross-sectional view of a steam condenser according to the fifth embodiment of the present invention. FIG. 9 is an enlarged view of a part of tube groups. FIG. 10 is a perspective view of a gas cooling part of an upper tube group.

The steam condenser according to the present embodiment has the same lower tube groups 5B1 and 5B2 as those of the first embodiment. However, the upper tube groups 5A1 and 5A2 of the present embodiment are different from those of the first embodiment.

Gas cooling parts 12A in the upper tube groups 5A1 and 5A2 are positioned respectively at lower parts of the upper tube groups 5A1 and 5A2, and are deviated to the side wall 21 of the container 1. The gas cooling parts 12A extend in the lengthwise direction of heat transfer tubes 3. The gas cooling parts 12A each are surrounded by an enclosure part 27A which is open laterally in the side facing the side wall 21. The enclosure parts 27A each have an outer end plate 135 and a top plate 136. The outer end plates 135 stand up from upper surfaces of the inter-tube-group inundation prevention plates 23 and extend in the lengthwise direction of the heat transfer tubes 3. The top plates 136 extend horizontally from upper ends of the outer side plates 135 toward the insides of the upper tube groups 5A1 and 5A2. Vicinities of ends of the inter-tube-group inundation prevention plates 23 are shared as parts of constructional elements of the enclosure parts 27A.

Gas extraction holes 42 are provided in each of the outer end plates 135. Gas extraction ducts 28A are connected to the outside of the gas extraction holes 42. The gas extraction ducts 28A extend horizontally toward the side walls 21 of the container 1, and are connected to a gas collection tubes 43 extending in the lengthwise direction of the heat transfer tubes 3. The gas collection tubes 43 are connected to a vacuum device not shown but provided outside the container 1.

Short pass prevention plates 139 extend upward from the upper surfaces of the inter-tube-group inundation prevention plates 23, in the direction of the heat transfer tubes 3. The short pass prevention plates 139 are taller than gaps 137 between the inter-tube-group inundation prevention plates 23 and the upper tube groups 5A1 and 5A2. Upper ends of the short pass prevention plates 139 are inserted in the upper tube groups 5A1 and 5A2. As shown in FIG. 10, a notch 140 is formed in the side surface of each short pass prevention plate 139 in the direction of the heat transfer tubes 3. The notch 140 is positioned at the substantial center of two adjacent support plates 4.

As shown in FIGS. 8 and 9, steam channel lanes 142 are provided, extending downward from the centers of the upper ends of the upper tube groups 5A1 and 5A2. Inundation prevention plates 133 and 134 in the upper tube groups 5A1 and 5A2 are horizontally provided in the middles of these tube groups 5A1 and 5A2.

In the steam condenser according to the present embodiment, the positions of the gas cooling parts 12A in the upper tube groups 5A1 and 5A2 are disposed at the lower ends of the upper tube groups 5A1 and 5A2 and are deviated towards the side wall 21. Besides, the gas cooling parts 12A are installed in contact with the inter-tube-group inundation prevention plates 23. Therefore, steam which is exhausted from the steam turbine 2 and flows down along the side wall 21 toward the gas cooling parts 12A without stagnancy while being condensed inside the upper tube groups 5A1 and 5A2.

Short pass prevention plates 139 higher than the gaps 137 between the inter-tube-group inundation prevention plates 23 and the upper tube groups 5A1 and 5A2 are provided on the inter-tube-group inundation prevention plates 23. Therefore, steam which flows down from the center steam channel 143 can be prevented from further flowing through the gaps 137 between the inter-tube-group inundation prevention plates 23 and the upper tube groups 5A1 and 5A2, and then, from directly flowing into the gas cooling parts 12A without flowing around the heat transfer tubes 3. Further, since notches 140 of the short pass prevention plates 139 are provided at the centers of the respective support plates 4, condensed water which is condensed in the upper tube groups 5A1 and 5A2 and accumulated on the inter-tube-group inundation prevention plates 23 can flow down into the center steam channel 143 from the gas cooling parts 12A.

In addition, steam channel lanes 142 are provided, extending downward from the centers of the upper ends of the upper tube groups 5A1 and 5A2. Steam flowing from above the upper tube groups 5A1 and 5A2 can be smoothly guided into the upper tube groups 5A1 and 5A2. Further, since the inundation prevention plates 133 and 134 are provided in the middles of the upper tube groups 5A1 and 5A2, condensed water which is condensed above the inundation prevention plates 133 and 134 is received by these plates and is prevented from falling down. In this manner, it is possible to restrain deterioration of the heat transfer efficiency of the heat transfer tubes 3 below the inundation prevention plates 133 and 134.

[Sixth Embodiment]

Figure 11:
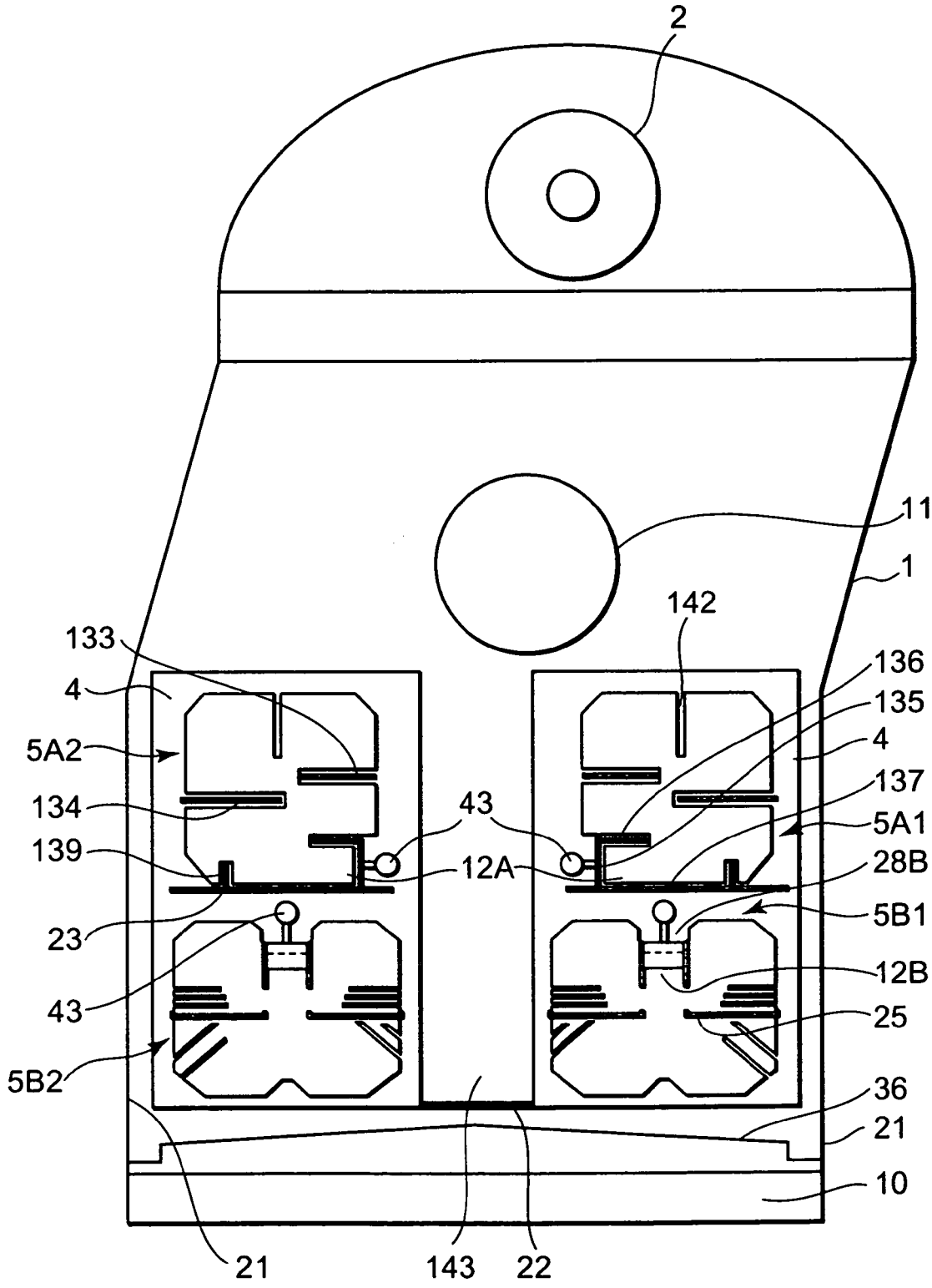
FIG. 11 is a front vertical cross-sectional view showing a steam condenser according to the sixth embodiment of the present invention.

FIG. 11 is a front vertical cross-sectional view of a steam condenser according to the sixth embodiment of the present invention.

The steam condenser according to the present embodiment has the same lower tube groups as those of the first embodiment. However, the upper tube groups 5A1 and 5A2 of the present embodiment are different, i.e., these tube groups have a structure in which each of the upper tube groups 5A1 and 5A2 in the fifth embodiment is inverted inside out.

In the steam condenser according to the present embodiment, the positions of the gas cooling parts 12A are at the sides facing the center steam channel 143, at the lower ends of the upper tube groups 5A1 and 5A2. The gas cooling parts 12A are provided in contact with the inter-tube-group inundation prevention plates 23. Stem exhausted from the turbine 2 flows down along the side wall 21 and further flows into the gas cooling parts 12A along the inter-tube-group inundation prevention plates 23 without stagnation, while being condensed inside the upper tube groups 5A1 and 5A2.

In addition, short pass prevention plates 139 higher than the gaps 137 between the inter-tube-group inundation prevention plates 23 and the upper tube groups 5A1 and 5A2 are provided on the inter-tube-group inundation prevention plates 23. Therefore, steam which flows in along the side wall 21 can be restrained from further flowing though the gaps 137 between the inter-tube-group inundation prevention plates 23 and the upper tube groups and then, from directly flowing into the gas cooling parts 12A without passing through the peripheries of the heat transfer tubes 3. Further, since notches 140 of the short pass prevention plates 139 are provided at the center of the support plates 4 adjacent to each other, condensed water which is condensed in the upper tube groups 5A1 and 5A2 and accumulated on the inter-tube-group inundation prevention plates 23 can flow down into the center steam channel 143 from the gas cooling parts 12A.

In addition, steam channel lanes 142 are provided, extending downward from the centers of the upper ends of the upper tube groups 5A1 and 5A2. Steam flowing from above the upper tube groups 5A1 and 5A2 can be smoothly guided into the upper tube groups 5A1 and 5A2. Further, since the inundation prevention plates 133 and 134 are provided in the middles of the upper tube groups, condensed water which is condensed above the inundation prevention plates 133 and 134 is received by these plates and is prevented from falling down. In this manner, it is possible to restrain deterioration of the heat transfer efficiency of the heat transfer tubes 3 below the inundation prevention plates 133 and 134.

[Other Embodiments]

The embodiments described above are mere examples, and the present invention is not limited to these embodiments. For example, in each of the above embodiments, the steam condenser has tube groups arrayed in two rows in the vertical direction and two columns in the horizontal direction. However, the tube groups may be arrayed in three or more rows and three or more columns. In case of three rows, the tube groups in the middle row are lower tube groups in relation to the tube groups in the uppermost row, and are upper tube groups in relation to the tube groups in the lowermost row.

Also in the above embodiments, both ends of each of four tube groups 5A1, 5A2, 5B1, and 5B2 are supported by two pairs of tube plates 6*a* and 6*b*. However, both ends of each of four tube groups 5A1, 5A2, 5B1, and 5B2 may be supported by one pair of tube plates.

What is claimed is:

1. A steam condenser condensing steam exhausted from a steam turbine, the steam condenser comprising:

a container having at least two side walls, configured to let the steam flow down therein from the steam turbine;

plural heat transfer tubes arrayed below the steam turbine in the container, letting a cooling medium flow inside, contacting the steam flowing down to condense the steam, extending horizontally, and grouped into at least two upper heat transfer tube groups and at least two lower heat transfer tube groups, the two upper heat transfer tube groups being arranged horizontally with a gap therebetween, the two lower heat transfer tube groups being arranged horizontally with a gap therebetween below the two upper tube groups, and each of the heat transfer tube groups including the plural heat transfer tubes arrayed in a grid;

plural tube plates supporting the plural heat transfer tubes;

a baffle plate provided at a lower position between the lower heat transfer tube groups and extending in a horizontal direction, to obstruct a flow of steam;

an inter-tube-group inundation prevention plate disposed at a position between the upper heat transfer tube groups and the lower heat transfer tube groups opposed vertically to each other, the plate extending in a horizontal direction to guide condensed water flowing down from upside, in a horizontal direction;

an enclosure part disposed in each of the heat transfer tube groups, the enclosure part having top plate and two side plates, the top plate being disposed so as to extend substantially horizontally in parallel with the heat transfer tubes and having a gas extraction hole, the two side plates extending downward from the top plate and also extending in parallel with the heat transfer tubes with a space between each other, with the gas extraction hole and the plural heat transfer tubes interposed therebetween; and a gas extraction duct connected to the gas extraction hole to guide gas from the enclosure part to outside of the container.

2. The steam condenser according to claim 1, wherein the number of the heat transfer tubes in each of the upper heat transfer tube groups is smaller than the number of the heat transfer tubes in each of the lower heat transfer tube groups.

3. The steam condenser according to claim 1, wherein an upper collar extending in a direction of the heat transfer tubes is formed at an end of the inter-tube-group inundation prevention plate.

4. The steam condenser according to claim 1, further comprising:

three in-upper-tube-group inundation prevention plates disposed among the plural heat transfer tubes in each of the upper heat transfer tube groups, extending in a horizontal direction, guiding condensed water flowing down from upside, in a horizontal direction, the in-upper-tube-group inundation prevention plates being disposed with gaps between each other; and plural within-lower-tube-group inundation prevention plates disposed among the plural heat transfer tubes in each of the lower heat transfer tube groups, extending in a horizontal direction, guiding condensed water flowing down from upside, in a horizontal direction, the within-lower-tube-group inundation prevention plates being disposed with gaps between each other; wherein a central in-upper-tube-group inundation prevention plate in the three in-upper-tube-group inundation prevention plates is disposed on the top plate.

5. The steam condenser according to claim 4, wherein axial cross-sections of the upper heat transfer tube groups at the sides close to the side walls of the container, below the in-upper-tube-group inundation prevention plates in two upper heat transfer tube groups adjacent to side walls of the container, among the at least two upper heat transfer tube groups, are substantially semi-circular shapes swelling toward the side walls of the container, and at least one steam passage lane is provided in each of parts of the substantially semi-circular shapes, the at least one steam passage lane extending horizontally toward one of the side wall of the container and guiding steam in a direction toward the center of the upper heat transfer tube group including the steam passage lane.

6. The steam condenser according to claim 4, wherein at least one steam passage lane for introducing steam in a horizontal direction from outside of the lower tube groups is provided above the within-lower-tube-group inundation prevention plates.

7. The steam condenser according to claim 4, wherein at least one lane for introducing steam in an obliquely upward direction from outside of the lower heat translation tube groups is provided below the within-lower-tube-group inundation prevention plates.

8. The steam condenser according to claim 4, wherein upper collars and lower collars each extending in the direction of the heat transfer tubes are formed at ends of the within-lower-tube-group inundation prevention plates in outer sides of the lower heat transfer tube groups.

9. The steam condenser according to claim 4, wherein the within-lower-tube-group inundation prevention plates are provided at a higher than center of the lower heat transfer tube groups.

10. The steam condenser according to claim 1, wherein the top plates of the enclosure parts provided in the lower heat transfer tube groups are provided at a position within 10% of height of the lower heat transfer tube groups from tops of the lower heat transfer tube groups.

11. The steam condenser according to claim 1, wherein the enclosure part of the upper heat transfer tube groups are disposed higher than center of the upper heat transfer tube groups.

12. The steam condenser according to claim 1, wherein the two side plates forming part of each of the enclosure parts in two upper heat transfer tube groups adjacent to the side walls of the container, among the at least two upper heat transfer tube groups, include an outer side plate close to one of the side walls of the container, and an inner side plate provided inside the outer side plate and extending lower than the outer side plate.

13. The steam condenser according to claim 1, wherein with respect to each of two upper heat transfer tube groups adjacent to the side walls of the container, among the at least two upper heat transfer tube groups, a protruding part including the heat transfer tubes arrayed in at least one horizontal row is formed along a lower end thereof farther from the side walls, and a concave region is formed where heat transfer tubes are not disposed, the concave region having a depth equivalent to at least two horizontal rows of the heat transfer tubes, is formed at a side of the protruding part close to the side wall.

14. The steam condenser according to claim 1, wherein the inter-tube-group inundation prevention plates adjacent to two upper heat transfer tube groups adjacent to side walls of the container, among the at least two upper heat transfer tube groups, each has an outer end facing the side wall of the container and an inner end opposite to the inner end, distance between the outer end and the side wall being equal to or larger than distance between the upper heat transfer tube group and the side wall, and the inner end of the inter-tube-group inundation prevention plates are closer to center line of the container compared to inner end of the upper heat transfer tube groups.

15. The steam condenser according to claim 1, wherein two upper heat transfer tube groups adjacent to the side walls of the container, among the upper heat transfer tube groups, are arranged respectively inside the lower heat transfer tube groups, gaps between the two upper heat transfer tube groups and the side walls being wider than gaps between the two lower heat transfer tube groups and the side walls 16. The steam condenser according to claim 1, wherein the inter-tube-group inundation prevention plates are positioned below center of the upper heat transfer tube groups and the lower heat transfer tube groups.

17. A steam condenser condensing steam exhausted from a steam turbine, the steam condenser comprising:

a container having at least two side walls, configured to let the steam flow down from the steam turbine;

plural heat transfer tubes arrayed below the steam turbine in the container, letting a cooling medium flow inside, contacting the steam flowing down to condense the steam, extending horizontally, and grouped into at least two upper heat transfer tube groups and at least two lower heat transfer tube groups, the two upper heat transfer tube groups being arranged horizontally in the container with a gap therebetween, the two lower heat transfer tube groups being arranged horizontally with a gap therebetween below the two upper tube groups, and each of the heat transfer tube groups including the plural heat transfer tubes arrayed in a grid;

plural tube plates supporting the plural heat transfer tubes;

a baffle plate provided at a lower position between the lower heat transfer tube groups and extending in a horizontal direction, to obstruct a flow of steam;

an inter-tube-group inundation prevention plate disposed at a position between the upper heat transfer tube groups and the lower heat transfer tube groups opposed vertically to each other, and extends in a horizontal direction to guide condensed water flowing down from upside, in a horizontal direction;

a lower tube group enclosure part disposed in each of the lower heat transfer tube groups, the enclosure part having a first top plate and two side plates, the lower tube group first top plate being disposed so as to extend horizontally in parallel with the heat transfer tubes and having a gas extraction hole, and the two side plates extending downward from the first top plate and also extending in parallel with the heat transfer tubes with a space between each other, with the gas extraction hole and the plural heat transfer tubes interposed therebetween;

an upper tube group enclosure part disposed in each of lower ends of the upper heat transfer tube groups at the sides close to the side walls of the container, the upper tube group enclosure part having an outer end plate standing from the inter-tube-group inundation prevention plates along an outer end of the upper heat transfer tube groups and having a gas extraction hole, and a second top plate connected to an upper end of the outer end plate and extending in parallel with the inter-tube-group inundation prevention plates, the plural heat transfer tubes being interposed between the upper tube group enclosure part and the inter-tube-group inundation prevention plates; and a gas extraction duct connected to the gas extraction holes of the first top plate of the lower tube group enclosure part and of the outer end plate of the upper tube group enclosure part, to guide gas from the lower tube group enclosure part and the upper tube group enclosure part to outside of the container.

18. The steam condenser according to claim 17, further comprising a short pass prevention plate standing up from each of the inter-tube-group inundation prevention plates, extending in direction of the heat transfer tubes, and having an upper end inserted in the upper tube groups.

19. The steam condenser according to claim 18, wherein the short pass prevention plate has a notch to let condensed water on the inter-tube-group inundation prevention plates flow in a horizontal direction.

* * * * *